US005787533A

United States Patent [19]

Fromme

[11] Patent Number: 5,787,533

[45] Date of Patent: Aug. 4, 1998

[54] CUSHION SUPPORT

[75] Inventor: Heinrich Fromme, Schloss Holte-Stukenbrock, Germany

[73] Assignee: FROLI Kunststoffe Heinrich Fromme, Schloss Holte-Stukenbrock, Germany

[21] Appl. No.: 620,160

[22] Filed: Mar. 22, 1996

[30] Foreign Application Priority Data

Mar. 24, 1995 [DE] Germany ..... 295 05 052 U
May 18, 1995 [DE] Germany ..... 295 07 948 U

[51] Int. Cl.[6] ..... A47C 27/06

[52] U.S. Cl. ..... 5/719; 5/247; 5/255; 5/264.1

[58] Field of Search ..... 5/719, 247, 255, 5/264.1; 297/452.49; 267/106, 164, 165, 149, 141

[56] References Cited

U.S. PATENT DOCUMENTS 5,588,165 12/1996 Fromme ..... 5/255

FOREIGN PATENT DOCUMENTS 0 031 132 12/1980 European Pat. Off. .
366065 5/1990 European Pat. Off. ..... 5/236.1
36 12 603 10/1987 Germany .

*Primary Examiner*—Brian K. Green
*Assistant Examiner*—Fredrick C. Conley
*Attorney, Agent, or Firm*—Burns, Doane, Swecker & Mathis, L.L.P.

[57] ABSTRACT

A cushioning support for a mattress comprises a plurality of elements forming a grid structure. Compression springs are mounted on respective ones of the elements. Bearing plates are disposed atop respective ones of the springs, and are disposed closely adjacent one another to form together a support surface for the mattress. The baseplates are removably interconnected so that the size and shape of the cushioning support can be varied to conform to the size and shape of a cushion to be supported. The springs can be detachably connected to the elements, or of one piece construction therewith.

10 Claims, 12 Drawing Sheets

Fig. 4
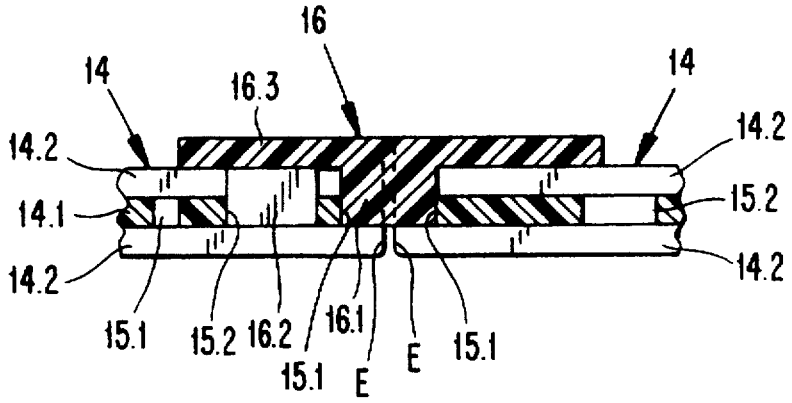
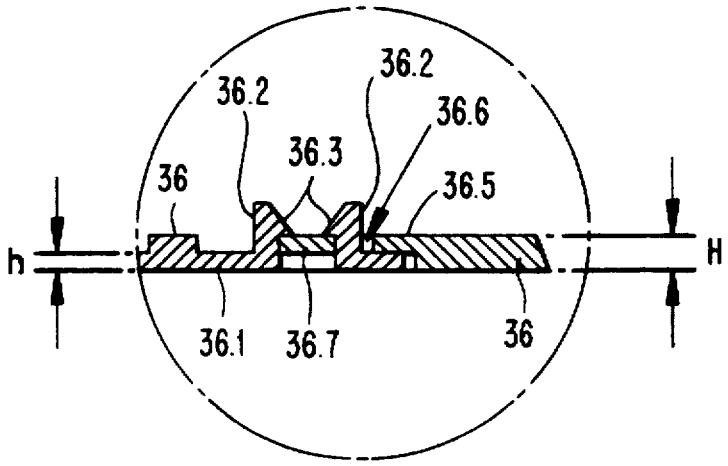
Fig. 5c

Fig. 8a
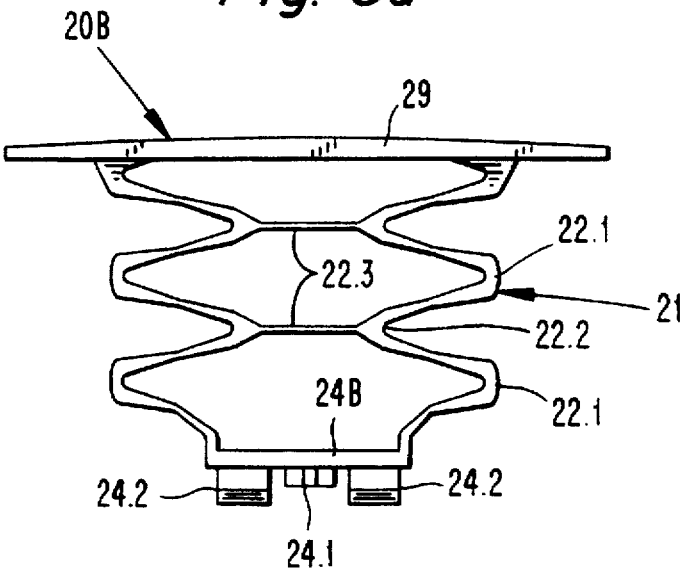
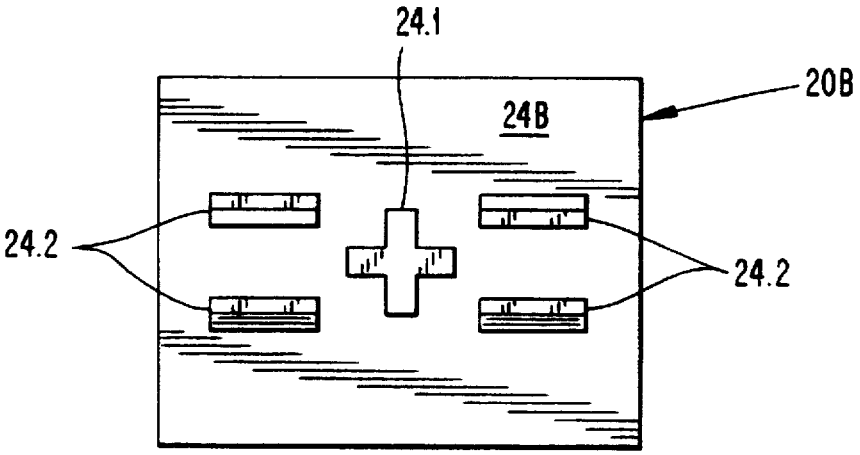
Fig. 8b

CUSHION SUPPORT

BACKGROUND OF THE INVENTION

The invention pertains to a cushioning support for cushions of various shapes and sizes which have spring elements placed on a rigid or semi-rigid base in regular sequence and spacing, wherein the spring elements can be attached to the base and carry bearing plates upon which a mattress overlay is placed, particularly for the retrofit of beds.

In the cushioning of beds, a well known design (for example from DE 36 12 603 A1, EP-A-0 031 132, and DE 93 17 114 U1) is known wherein the sleeping surface is divided up into individual areas. Each of these individual areas has a bearing plate. The sum of these bearing plates forms the sleeping surface which is provided with a (simple) overlay (e.g., a mattress). This type of cushioning offers considerably more comfort compared to mattresses placed on slats. Such cushion bases must always, however, be combined with a mattress frame so that only the dimensions of the bed can be accommodated, wherein its rectangular form must be taken into account. Retrofit of unusual shapes or shapes differing from rectangular shapes is not possible.

SUMMARY OF THE INVENTION

The objective of the invention is therefore to propose a cushion base of this general type which advances a step beyond the previous state of the technology, and which is adjustable to the size and shape of the cushion or sleeping surface and which conserves weight, which allows problem-free retrofit of existing cushion surfaces, particularly of beds and which can be manufactured economically and easily with ease of installation.

The present invention relates to a cushioning support for cushions, comprising a plurality of elements forming a grid structure; compression springs mounted on respective ones of the elements; and bearing plates disposed atop respective springs. The bearing plates are disposed closely adjacent one another to form a support surface for a cushion. The elements are removably interconnected so that the size and shape of the cushioning support can be varied to conform to the size and shape of a cushion to be supported.

Preferably, the springs are detachably connected to the elements. The elements include cross pieces, and arms interconnecting the cross pieces. Springs can be connected to the cross pieces as well as to the arms. The arms can be detachably connected to the cross pieces, or formed integrally of one piece construction therewith. The springs could be of one piece construction with the elements or separate therefrom.

The spring elements can include feet constructed as plug connectors bridging the points of contact between the cross pieces and the connecting strips or between two connecting strips. With this design, the spring elements themselves connect cross pieces to one another. Alternatively, or in addition, separate connector strips can be provided to perform that function.

The cross pieces and/or the connection strips serve as seats for the spring elements. The spring elements are either built into the baseplate of the cross pieces in one piece or they are constructed as spring elements whose feet sections have plug or gripping elements which are inserted into corresponding openings in the cross pieces. It is obvious that the cross pieces can also have plug elements, somewhat like dowels, which are inserted into corresponding openings in the foot pieces. As an advantage, the dowels or their holes are constructed such that a clamping effect takes place fixing the dowel in the hole.

An advantage of the baseplate is its rectangular construction, wherein two adjacent edges, oriented at a right angle to one another, have adapters with tabs and the other two edges, likewise perpendicularly adjacent to one another, have notches. The tabs and notches are arranged in pairs symmetric to the centerline of the spring element. At the two other edges at least one tab or notch corresponding to one of these tabs or notches is provided which are designed such that they are interlockable and snap together with cooperating latching means. This construction allows interlocking of the baseplates, whereby the connections are stabilized symmetric to the centerline by the paired arrangement of the tab adapters and the notch adapters.

The baseplates of the spring elements can be interlocked to cushioning bases in (nearly) any shape with these notch connections, particularly when using the design with minimal width (one tab adapter or notch adapter on opposite edges). As an advantage, the tab adapters are constructed such that their material thickness "h" is half of the thickness "H" of the baseplate. The notch adapters have, in contrast, free spaces in the vicinity of overlap with a depth corresponding to the material thickness "h" of the tab adapters. With this measure, the thickness of the baseplate is the same throughout in the contact region; bulges at the contact points are eliminated.

In an alternate design, the baseplate is constructed rectangularly and has a tab adapter at the narrow edge and a notch at the opposite side. These adapters are aligned with the centerline of the spring element. The longer sides, in contrast, are provided with two tab adapters and two notch adapters aligned symmetric to the center. In another alternative design, the baseplate is constructed as a square. It has two tab adapters at two adjacent, perpendicular sides and two notch adapters on both sides of centerline at the other two opposite sides with which they correspond to and align with. With this design, the baseplate is strictly symmetric and allows adding—on more baseplates in both directions, wherein more rectangular surface portions (i.e., half or quarter plates) can be placed in order to provide cushion shapes which deviate from the norm and/or are not bound by perpendicular lines.

The means of interlocking are preferably tabs with built-in tips which are arranged back-to-back, wherein the other interlocking means cooperating with it are designed as a notch whose edges are gripped by the outward facing tips. In another design, the tips face inward and cooperate with a web forming the boundary of the notch. In both arrangements, the two tabs effect a latch connection against one another so that the tab location is defined.

These grid elements so connected to one another allow direct attachment to a flat base. With this design, a surface to be cushioned can be provided with a gridwork of arbitrary shape wherein the bearing plates cover nearly the entire cushioned surface except for the separation of the bearing plates from one another. The base does not have to be an even base, it could also be provided with cushioning unevenly due to the flexibility of the gridwork constructed from the grid elements—for example with a tilted seating of the head/neck region or back region. Also, a completely one-piece base is not needed since gaps can also be bridged with this gridwork.

The spring elements, which each of the grid elements has, make it possible to install a mattress overlay which does not put too much demand on the spring characteristics—due to the spring characteristics of the springs in the grid elements. While in the first design, the grid elements are connected to one another in a regular matrix, in the second example the grid elements placed in regular arrangement are coupled by means of intermediate connection strips resulting in the same grid arrangement; these connection strips can be built into the cross pieces accordingly; they can also be inserted as installed strips between the cross pieces so that the cross pieces of both designs are connected together.

According to an advantageous development, the spring elements in the crossing region or along the connecting arm are fitted with holders built-in to the cross piece or the connecting arm. Holders are provided on a baseplate installed on the backside of the grid which are inserted through openings in the cross piece or connecting arms and which follow the shape development of the feet. Cross pieces as well as connecting arms are provided with orderly arranged penetrations through which the spring element holders can be inserted. These are centrally arranged penetrations which, in one design, allow a closed shape; its cross section is triangular, cross-shaped, or the like.

In another development, a central round hole is provided in the center of a cross piece into which a tap, attached to the spring element, is inserted. This design allows the spring element to be rotated; the central round hole is provided with at least one, preferably two, locking ramps which form a sloped surface partially around the hole. The holder inserted in this hole is designed stud-shaped and is fitted with a tip which grips the locking ramp(s). This design allows tightening and locking. The tip is made of a tightening rod which is perpendicular to the axis of the tap whose upper ends glides along the sloped surface of the locking ramps and thus tightens the spring to the base.

To simplify manufacture, the cross pieces, at least, are designed as synthetic injection molded parts; it is advantageous if the connecting strips are of one piece with the cross pieces here as arms. As an alternative to this, the connecting strips are attached to the cross pieces as specialty parts. To connect the two, connectors are provided where the cross piece and connecting arm meet. It is advantageous here to design the foot of the spring element such that it can be used as a connector.

It is also advantageous, if the connecting strips are designed as injection molded parts made of synthetic material; and alternative to this are connecting strips made of extruded parts made of synthetic material. The latter design, in particular, provides a profile with back taper for fastening of correspondingly designed spring element feet.

In an advantageous further development, the baseplates are also molded out of synthetic material with spring elements and their bearing plates in one piece; the advantage is when a number (2, 3, or 4) of the baseplates connected together are molded in one piece. With this single-piece manufacturing, which is designed to use synthetic material for the entire spring element, the spring elements thus obtained can be directly attached. Further handling for completion of these spring elements is superfluous.

In an alternative design, the baseplate and the spring element are manufactured with a head plate as necessary for which various synthetic materials can be employed. These spring elements must however undergo further treatment for completion. While separate manufacture of the baseplate and spring gives the advantage that different synthetic materials can be used, a single-piece construction results in economical manufacture of larger units which can be used to assemble the gridwork. In one-piece construction of multiple baseplates, it is obvious that the prescribed pattern of the tabs and tab seats is also to be maintained here so that elementary baseplates or partial baseplates can be assembled such that it does not depend on whether these baseplates are one-piece with the spring element with spring and bearing plate provided, or whether they must be attached subsequently. This allows use of different "stiffer" cushioning elements in a gridwork.

The grids thus constructed can be adjusted in a simple way to the shape and size of a bed, seat or horizontal surface, for example in an RV or on board a boat. The grid is provided with spring elements which determine the cushion characteristics of the support; thus, in these types of supports, simple overlays can be used instead of expensive mattresses, perhaps of simple foam overlays. These don't have a long life-span, especially with the treatment on board a boat, and changing them out—contrary to changing out a mattress can be economically justified. By cutting to the shape and size, meshes are also "cut into". With this, holes can arise near the edges which can still be filled with half-bearing plates (or bearing plates which are cut to the size required). However, the surface to be cushioned, not including these holes possible at the edges, is covered flat and the empty points directly at the edge are not disturbed, they are covered by the overlay.

A particular use for this type of construction of a cushioned surface is when the grid with its spring elements, on its rigid or semi-rigid support, is sewn into a covering with a more or less stiff cushion overlay. A mattress-type cushion similar to a futon results which can be laid onto a flat floor on its own.

BRIEF DESCRIPTION OF THE DRAWING

The invention is explained in more detail with the reference to the illustrations shown in FIGS. 1 through 9, wherein.

FIG. 4 is a sectional view of a connector taken along line 4—4 in FIG. 3;

FIGS. 5*a*–5*c* illustrate a cushion base, constructed from a first type of spring elements with their baseplates assembled together: FIG. 5*a* depicts a plan view of spring elements assembled by "half" spring adapters; FIG. 5*b* depicts a section taken along line 5*b*—5*b* in FIG. 5*a;* and FIG. 5*c* depicts a fragmentary section of area Z of FIG. 5*b;*

FIG. 6*a* illustrating a top view (bearing plate partially cut out); FIG. 6*b* depicting a side view of FIG. 6*a; * and FIG. 6*c* depicts a different side view of FIG. 6*a;*

FIG. 7*a* depicts a top view; FIG. 7*b* depicts a side view, and FIG. 7*c* depicts a side view, turned 90° from FIG. 7*b;*

FIGS. 8*a*–8*b* illustrates another type of spring element with integrated pedestal mount; FIG. 8*a* depicts a side view of the spring element unmounted; FIG. 8*b* depicts the pedestal plate of the spring element, viewed from below; FIG. 8*c* is an exploded side view of the spring; and FIG. 8*d* is a sectional view through an assembled spring.

DETAILED DESCRIPTION OF PREFERRED EMBODIMENTS OF THE INVENTION

Figure 1:
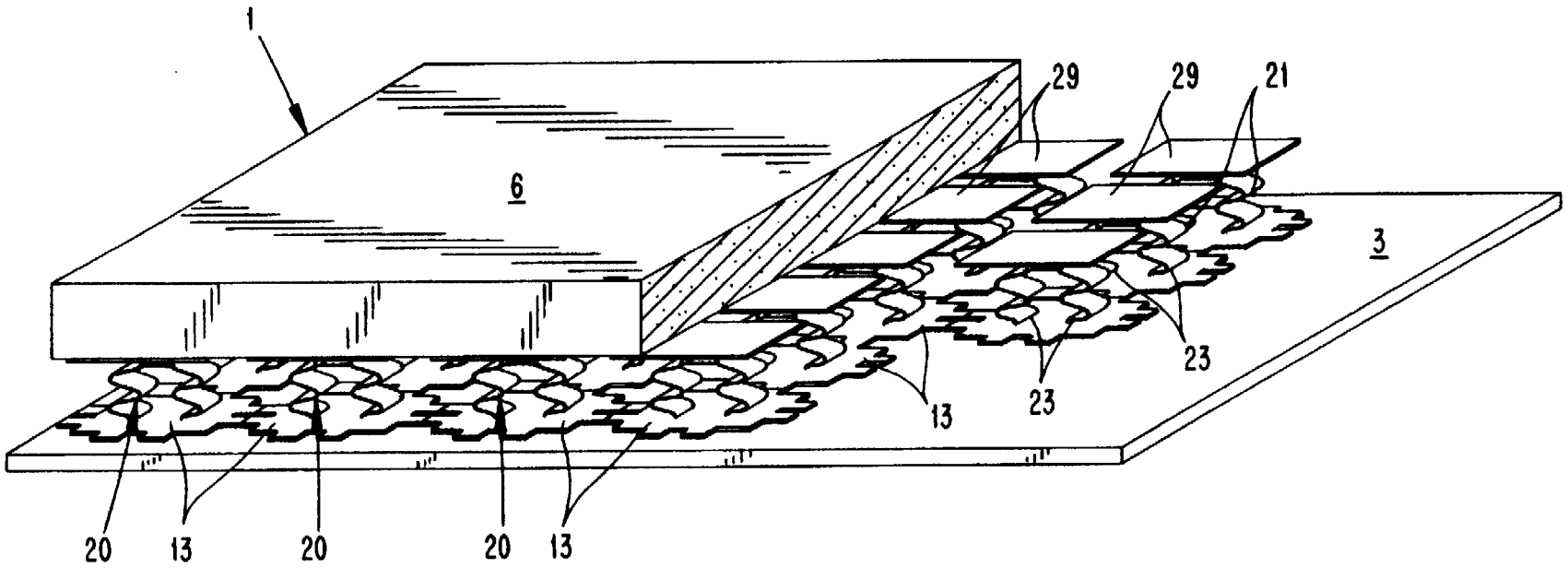
FIG. 1 is a perspective view of a cushioned sleeping surface according to the invention.

FIG. 1 shows a perspective scheme of a cushioned surface 1 in a framework provided with a support 3. A grid is placed on this support 3. The grid carries spring elements 20 each of which includes a spring 21 and a bearing plate 29. These bearing plates form sections of a cushioning surface onto which the mattress 6 is placed. Each spring 21 has a lower end or foot 23 sitting on a base or cross piece 13, and an upper end or head joined to the bearing plate 29. In this illustration, the foot 23 of the spring 21 is connected to the cross piece 13 so that the spring 21 is held solidly on the cross piece 13. The cross pieces and arms constitute elements of the grid. The cross pieces constitute baseplates for the spring elements.

Figure 2:
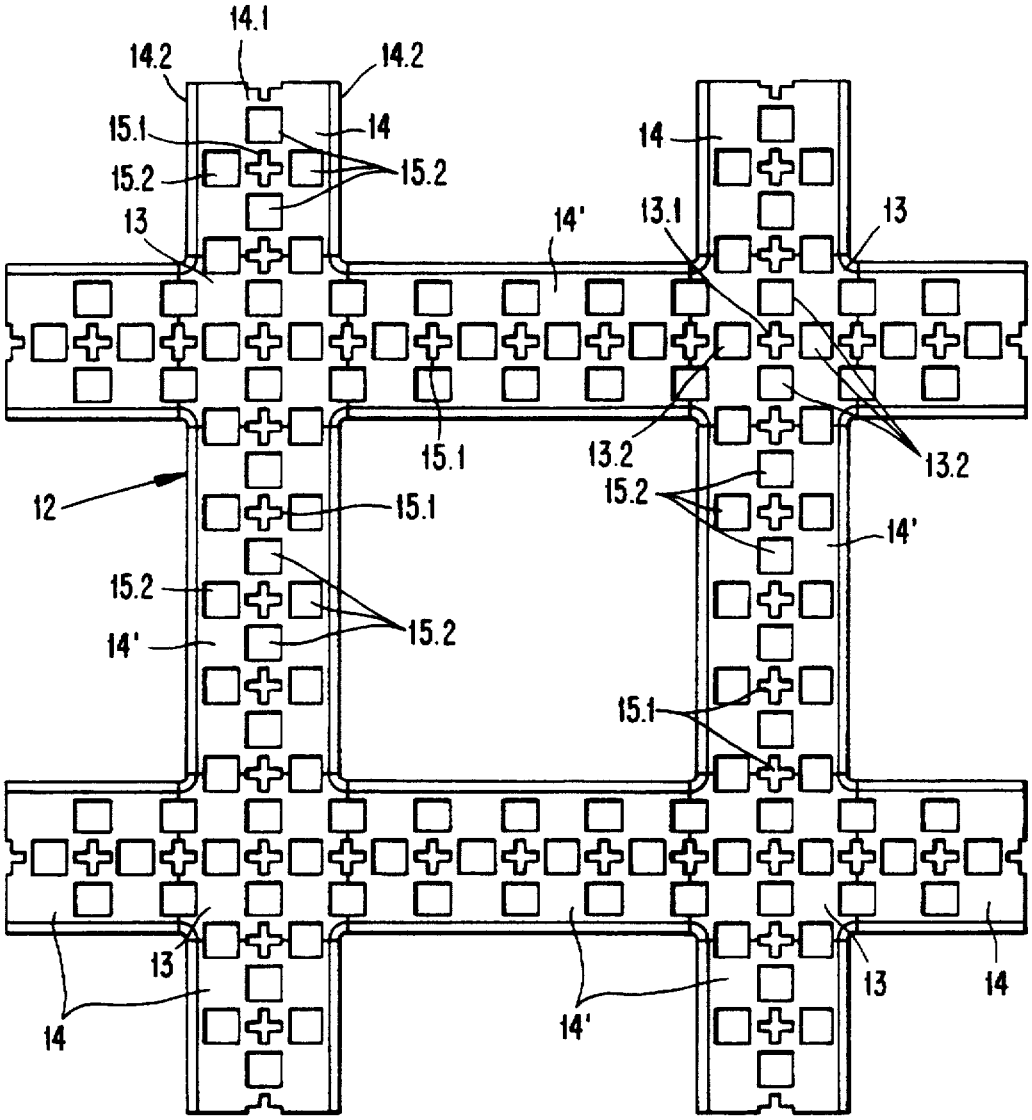
FIG. 2 is a multiple-piece grid mesh consisting of 4 grid elements.
Figure 3:
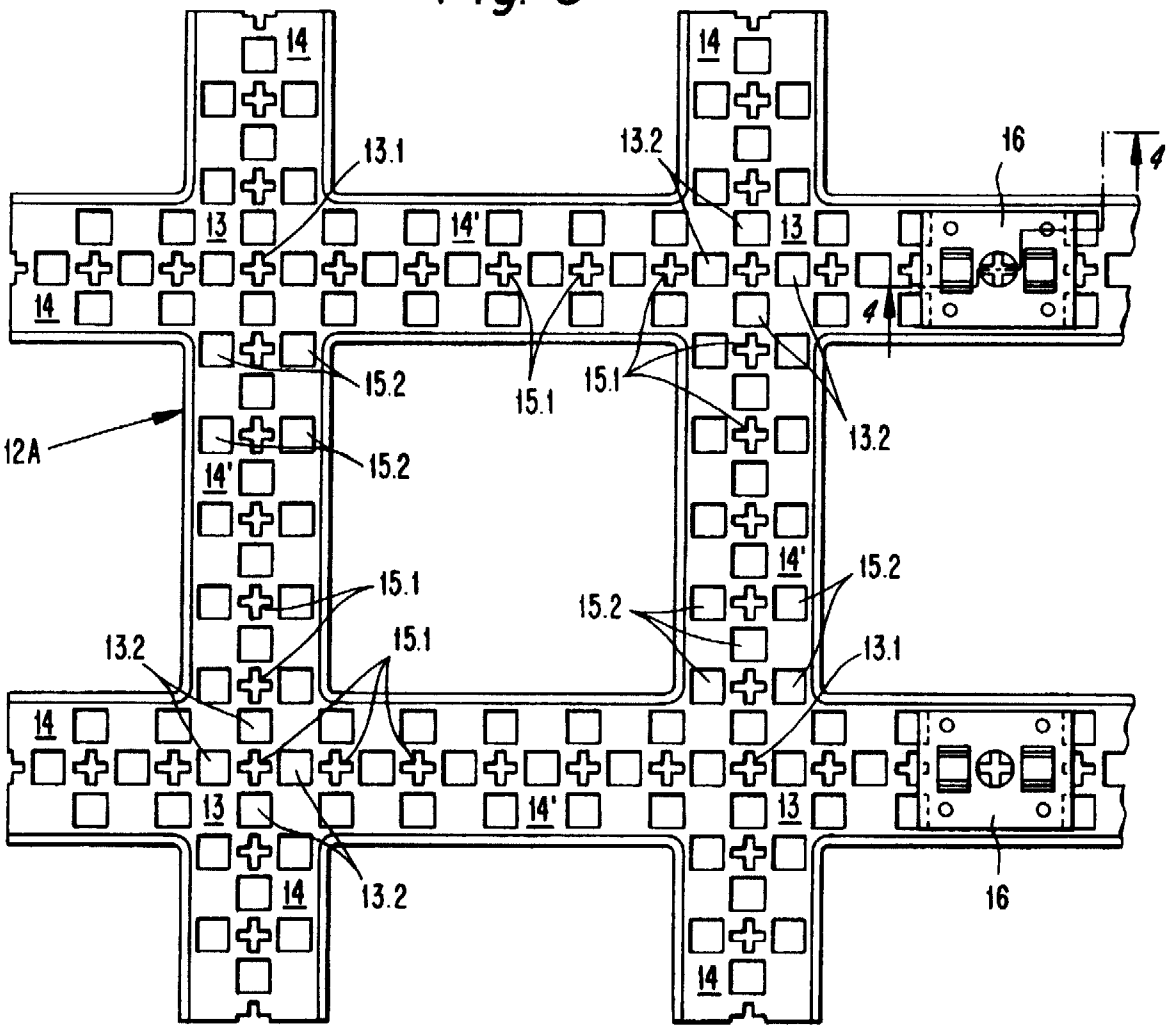
FIG. 3 shows a one-piece grid mesh, constructed from 4 grid elements.

FIGS. 2 and 3 show two different designs of a grid. FIG. 2 illustrates a grid mesh 12 formed by the interconnection of cross pieces and arms, whereas FIG. 3 shows a one-piece grid unit 12A. In FIG. 2 the cross pieces 13 are formed separately from the arms 14 and are interconnected thereto, e.g. by connectors 16 to be discussed. Two of the arms 14 extending from each cross piece are of half-length, whereas the two other arms 14' are of full length and serve to interconnect the cross pieces. In an alternate embodiment (not shown), each cross piece 13 could be formed of one piece with four half-length arms 14, with those arms being connected to other arms to form a grid. As many cross pieces 13 and arms 14 (or 14') can be interconnected to form a grid as large as desired, and of any desired shape.

If the cross pieces 13 and arms are formed separately, then preferably the cross pieces are injection molded of synthetic material (e.g., plastic) and the arms are extruded of the same material and cut to size. If the cross pieces and arms are formed of one piece, then preferably an injection molding method utilizing plastic is used.

Each arm 14 or 14' is essentially I-shaped, having a central web 14.1 and side flanges 14.2 on both sides.

To enable the cross pieces and arms to be interconnected and attached to springs, the cross pieces and arms are formed with holes or cut-outs 13.1, 15.1 for receiving corresponding projections formed on connectors 16, or formed on the spring elements themselves.

The connector 16 comprises a base 16.3, a central protruding tip 16.1 of star-shape to be received in a cross shaped cut-out 15.1 formed by the abutting ends E of two legs 14, and a pair of additional tips 16.2 (only one being visible in FIG. 4) shaped to be received in the cut-outs 15.2. A connector 16 can connect an arm with another arm or with a cross piece.

It will also become apparent that the feet of the spring elements can have a pattern of projections similar to that of the connector 16 to enable the springs themselves to be mounted in the cross pieces 13 and/or arms 14, 14', and to function as connectors for interconnecting the cross pieces and arms. That is, by overlapping a spring element with respect to a cross piece and an arm, that spring element can serve to join the cross piece and arm together.

Figure 5A:
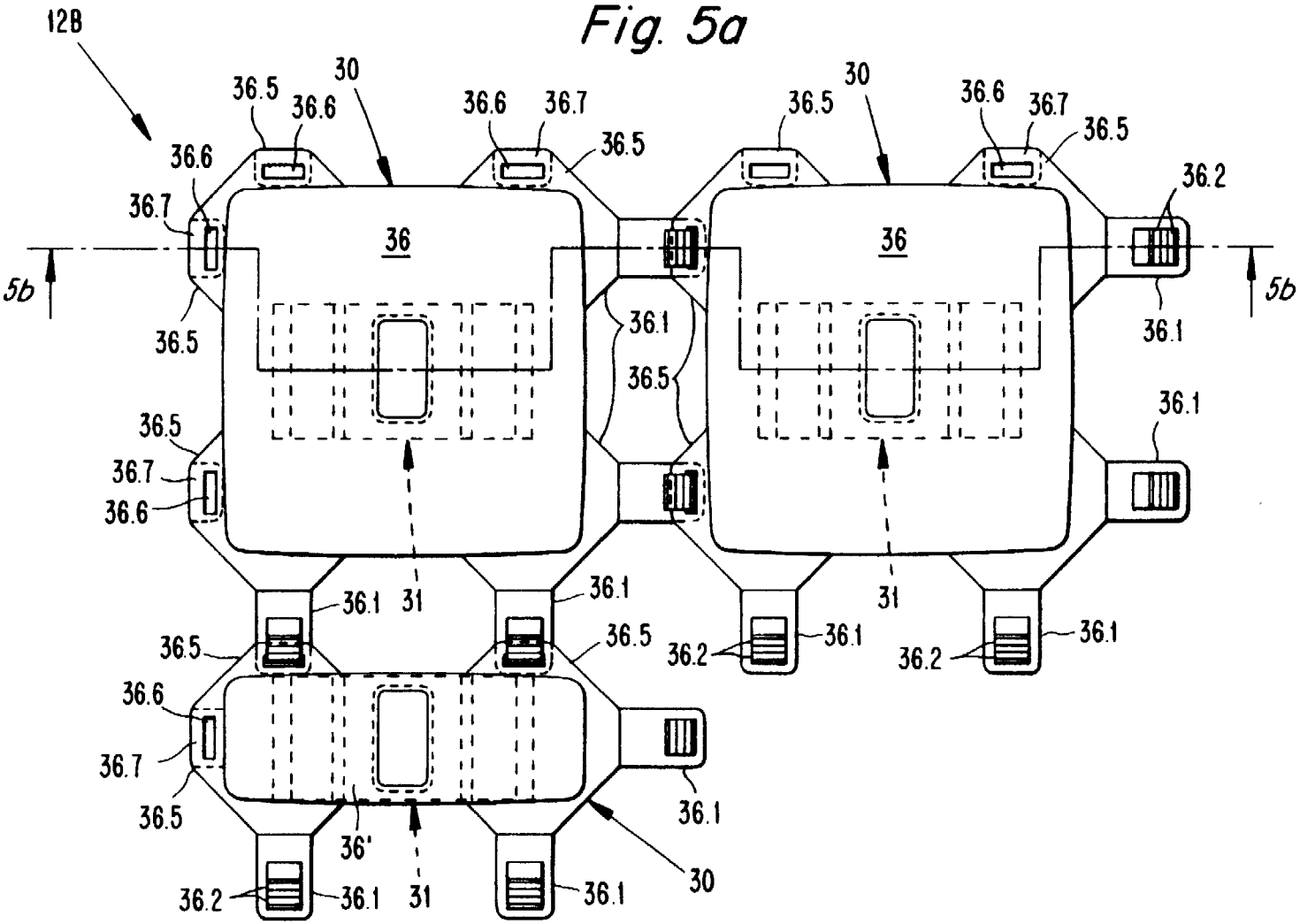
Figure 5B:
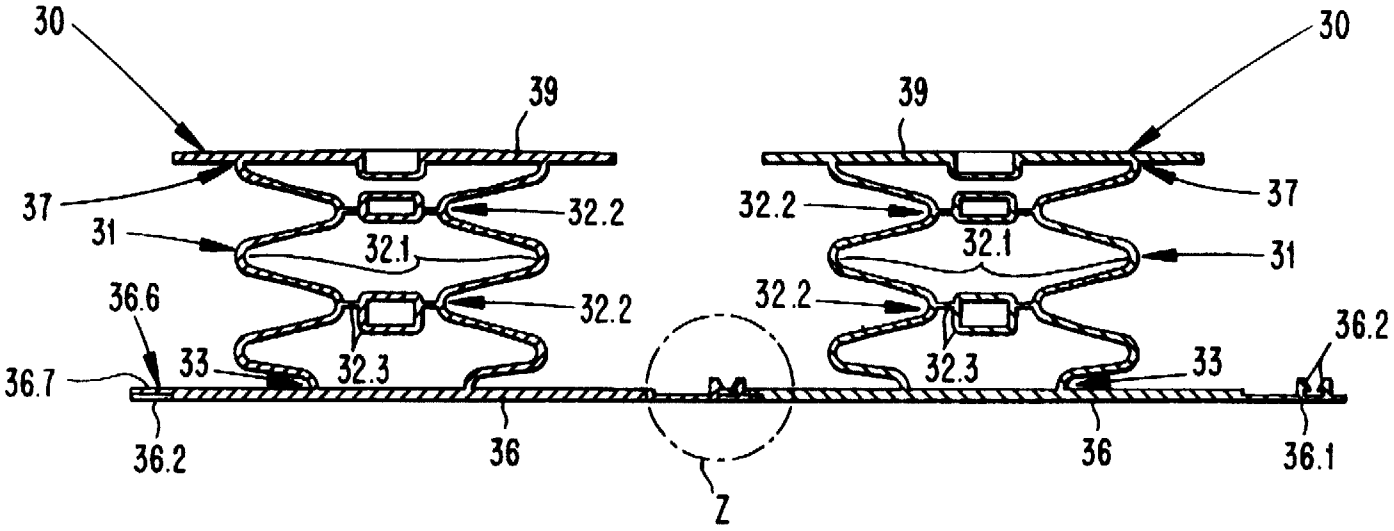

Another grid embodiment 12B is shown in FIGS. 5*a*–5*c* wherein the cross pieces are defined by baseplates 36 of the spring elements 30. These baseplates 36 are integral with the feet 33 of the foldable springs 31 which are represented as two oppositely arranged folding webs 32 having outer folds 32.1 and inner folds 32.2. The inner folds have stress members for adjustment of the spring characteristics, designed with hollow profiles. The top 37 of each foldable spring 31 is integral with the bearing plate 39 on which the mattress shaped cushion overlay is placed.

The baseplates 36 are either square or rectangular. In square designs, two adjacent perpendicularly-related edges are provided with adapters 36.1 having tabs 36.2, and the other two likewise adjacent perpendicularly related edges are provided with adapters 36.5 having notches 36.6. The tab adapters 36.1 and the notch adapters 36.5 align with one another. In the rectangular baseplates 36', long side edges and narrow sides are present wherein the two opposite long sides have two tab adapters 36.1 arranged symmetric to the centerline of the spring 31, and the narrow sides have one notch adapter 36.1 lying along the centerline of the spring 31. These baseplates are provided with tabs 36.2 or notches 36.6 which align with each other. Analogously, this also holds true for the narrow sides, which are provided with a tab adapter 36.1 and a notch adapter 36.5 which are again aligned. Since the rectangular baseplates 36' have exactly half the width, measured with the adapters 36.1, as the square baseplates 36, these baseplates 36, 36' can be combined easily.

The tab connection between the baseplates 36 or 36' consists of the tabs 36.2 which are pressed over the web 36.7 formed by the notch 36.6, and the tips 36.3 are thus pushed apart during insertion and the tabs 36.2 are elastically deformed; based on this elastic deformation, these tabs spring back after insertion whereby the tips 36.3 grip behind the outer edges of the web 36.7. The adapters 36.1 are constructed with tabs 36.2 such that their height "h" corresponds to half of height "H" of the baseplate 36, while the adapters 36.1 provided with the notches 36.6 are selected such that, in the vicinity of the overlap, the height of the free spare 36.5 corresponds to height "h" of the adapters 36.1 provided with tabs 36.2.

Figure 6A:
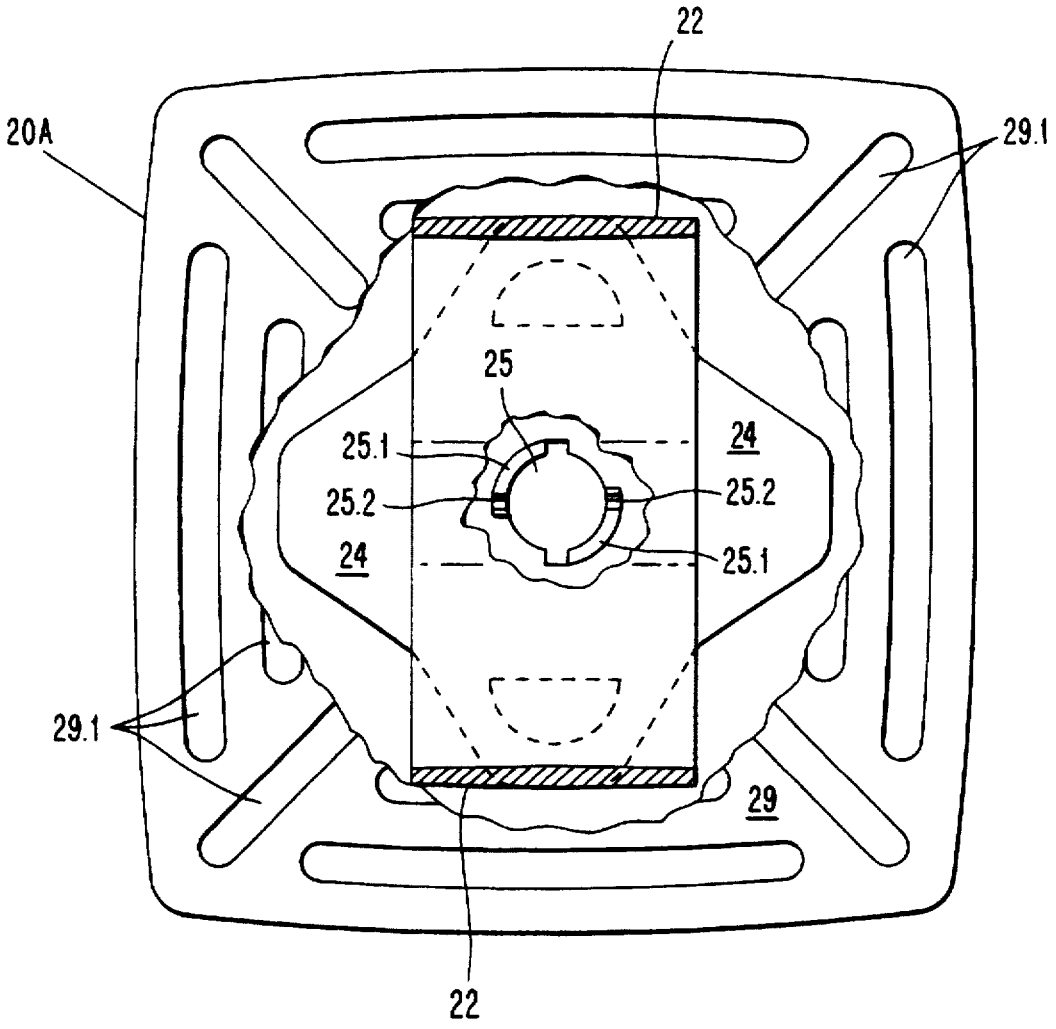
FIGS. 6*a*–6*c* illustrate another type of spring element to be fastened to the cross piece or arm.
Figure 6B:
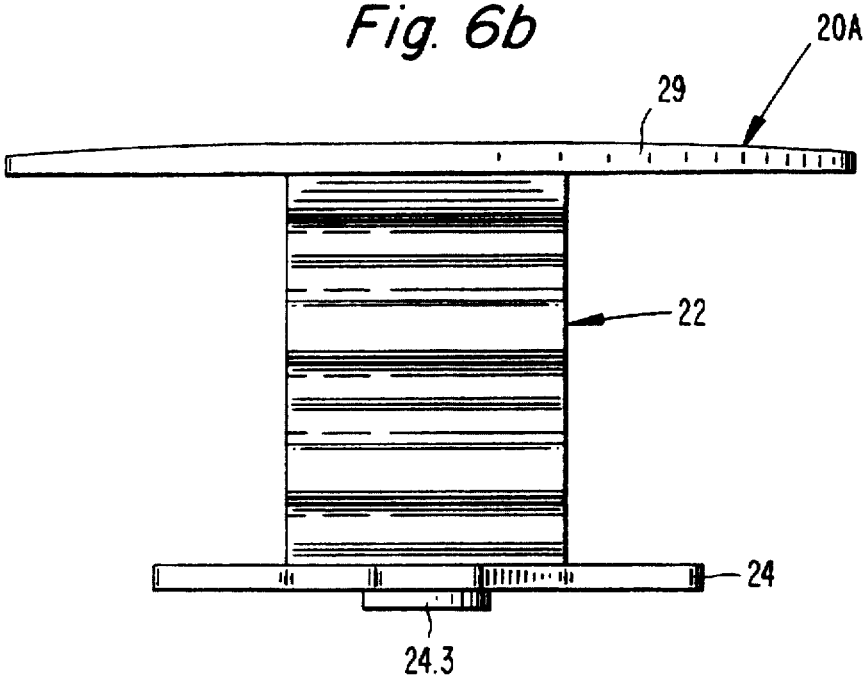
Figure 6C:
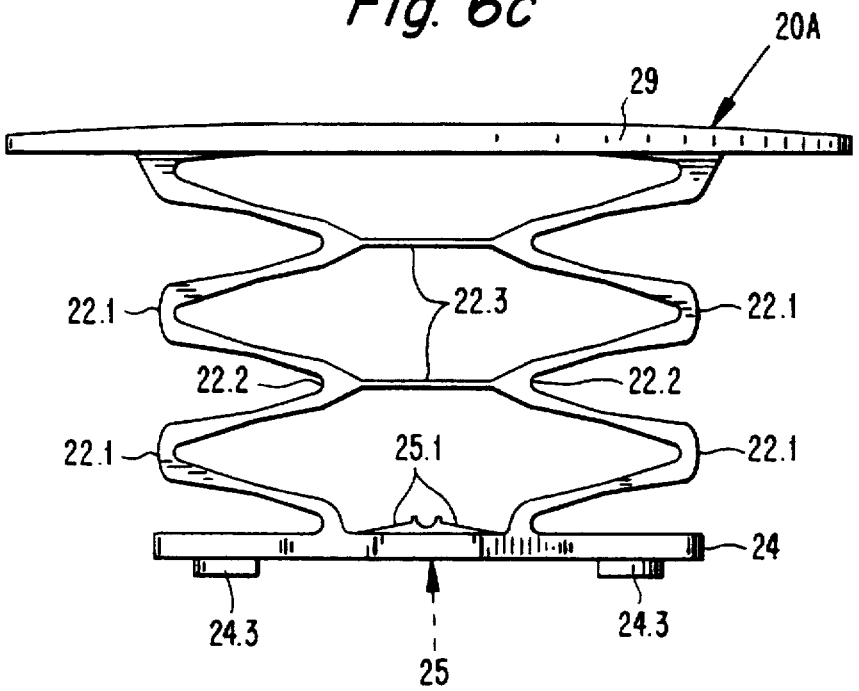

FIGS. 6*a*–6*c* show a spring element 20A that is adapted to be mounted on a cross piece 13 or arm 14 (or 14') by a separate baseplate 26 (FIGS. 7*a*–7*c*) which would be inserted from beneath the cross piece or arm as will be explained. The spring element 20A is shown in a top view with a partially removed headplate in FIG. 6*a*, and is shown in side views in FIGS. 6*b* and 6*c*. The spring element 20A consists of a spring 21 represented in the design example by two oppositely arranged folding webs 22 each having outer folds 22.1 and inner folds 22.2. To stabilize and adjust the spring characteristics, tensional members 22.3 are provided which connect at least some of the inner folds 22.2 together. Although FIG. 6*c* shows both inner folds 22.2 connected with such tensional members 22.3, not all inner folds 22.2 need be so connected; the number depends on the desired stiffness of the spring elements 20A. The pedestal 24 is provided with a center hole 25, into which the tap 26.1 of the baseplate 26 is to be inserted (see FIGS. 7*a*–7*c*). Two diametrically opposed peripheral ramps 25.1 are provided which cooperate with securing rods 26.2 of the baseplate 26 and which have notches 25.2 on their high side into which the securing rods 26.2 latch to secure their position (e.g., such as a so-called bayonet connection). On the bottom side of the pedestal 24 facing the grid are tips 24.3, which engage into corresponding cut-outs 13.2 and 15.2 in the cross pieces 13 and arms 14 (or 14'), respectively, of a grid assembled from these cross pieces and arms, thus securing the position of the pedestal 24. The head of the spring element 20A forms the bearing plate 29 which is stiffened with ribs 29.1, whereby the position of the ribs determine the degree of stiffening. It is obvious that in place of a baseplate 26, the center plate of a cross piece 13 or an arm 14 can be provided with the top 26.1.

Figure 7A:
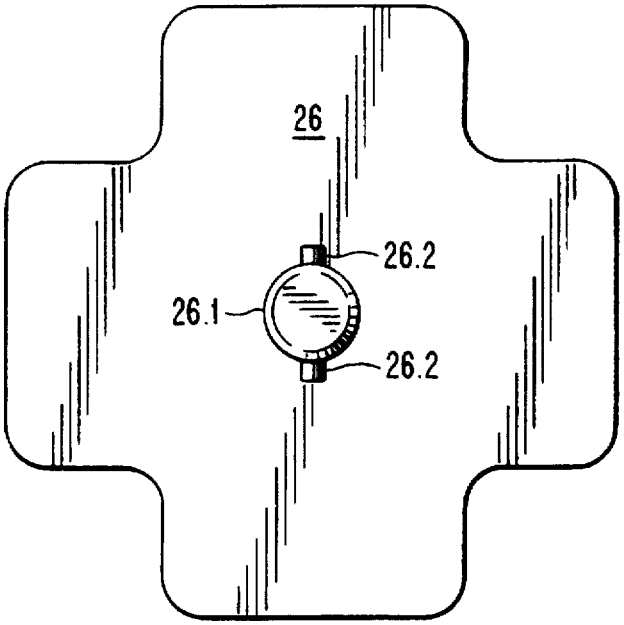
FIGS. 7*a*–7*c* illustrate the baseplate for attaching the spring elements of FIG. 6*a*–6*c* to a grid.
Figure 7B:
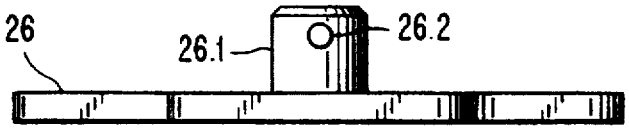
Figure 7C:
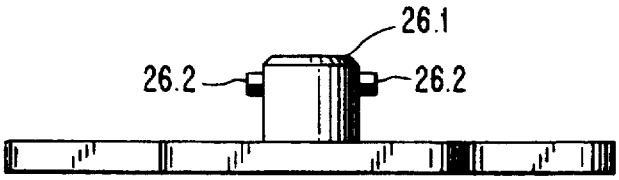

FIGS. 7*a*, 7*b*, and 7*c* show the design of a baseplate 26 from the top (FIG. 7*a*), as well as in two side views turned 90° (FIG. 7*b* and 7*c*). These views could also apply to a cross piece 13 or arm 14, 14' provided with a tap 26.1. With this design it is possible to fasten the spring elements easily so that they are laid out in the desired position in the cross pattern. This baseplate 26, which is formed to correspond to the pedestal 24 of the spring element 20A, engages into the center hole 25 of the pedestal 24 of the spring element and centers it; rotating the spring element 20 by 90° locks the securing rod 26.2 so that the spring elements are fastened to the grid by this connector 26.

In FIGS. 8*a* and 8*b*, another type of fastening of spring elements 20B to the grid is represented which is especially significant when grids assembled from cross pieces 13 and arms 14 (see FIGS. 2, 3) are used. The bottom side of the pedestal 24B of the spring element 20B facing the grid is provided with a cross-shaped central guide 24.1 cooperating with the center cut-outs 13.1 of the cross piece 13, or cut-outs 15.1 of the arms 14, and which fits snugly into these cut-outs. Tips 24.2 cooperate with the other cut-outs 13.2 of the cross piece 13 or 15.2 of the arms to secure the inserted spring element 20.

Figure 8C:
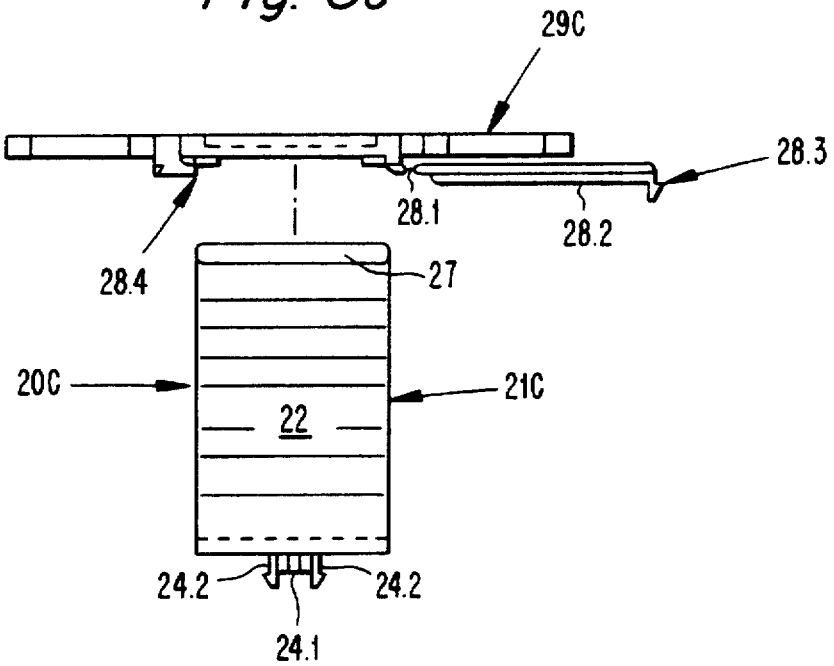
FIGS. 8*c* and 8*d* illustrate yet another type of spring in which the spring element is a separate piece from the bearing plate.
Figure 8D:
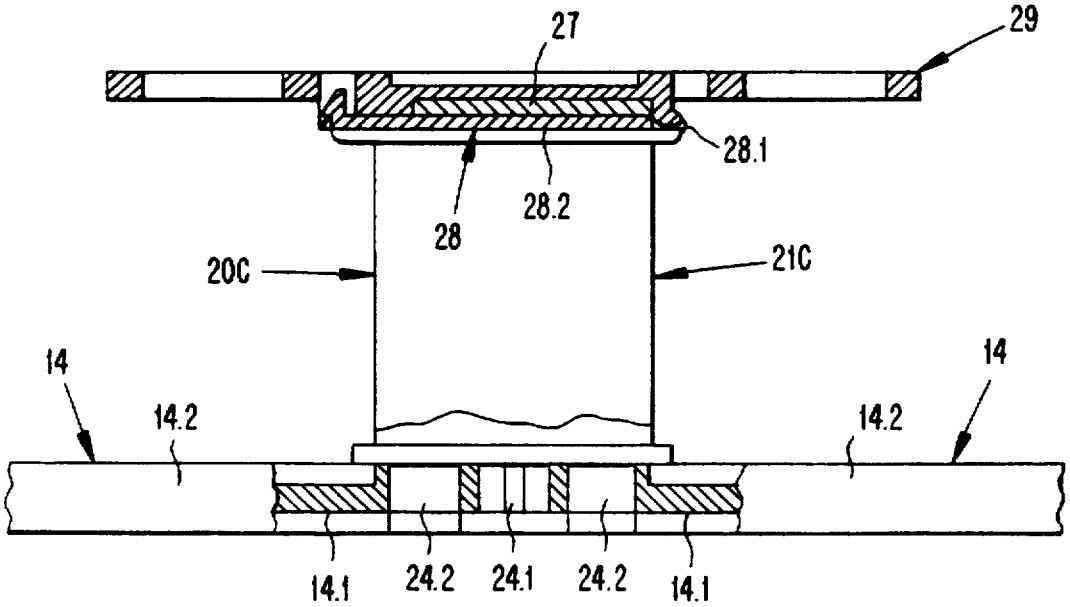

In FIGS. 8*c* and 8*d*, a spring element 20C is not formed integrally of one piece with the bearing plate 29C as in FIGS. 8A and 8B, but rather is connected thereto by a fastening mechanism. The fastening mechanism comprises a clip 28.2 hinged at 28.1 to an underside of the bearing plate. The clip 28.2 can be formed of one piece with the plate 29C, whereby the hinge comprises a reduced-thickness section of the material. Alternatively, a separate hinge pin could be provided. The top of the spring element comprises a plate 27 which becomes trapped between the bearing plate 29 and the clip 28.2 when the clip is swung to a closed position as shown in FIG. 8*d*. The free end of the clip comprises a hook 28.3 which becomes releasably attached to a catch tab 28.4 of the bearing plate 29 when the clip is swung closed.

Figure 9:
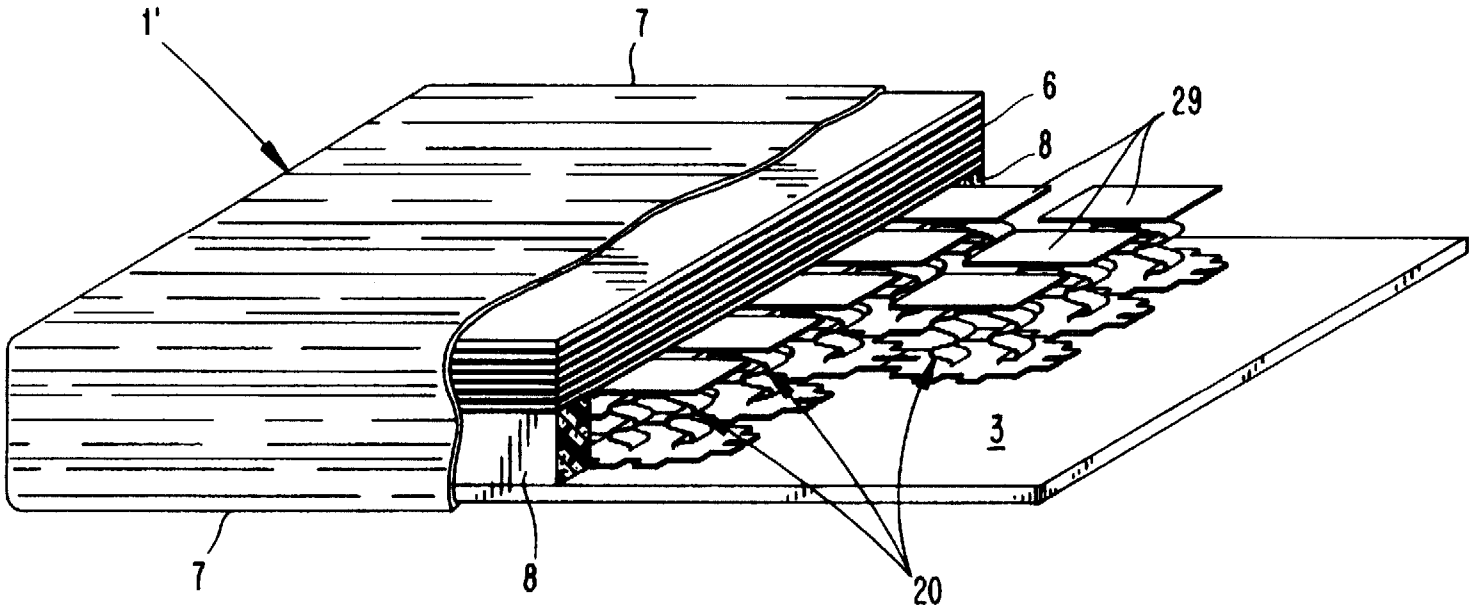
FIG. 9 illustrates the cushion element contained in an outer fabric casing.

FIG. 9 shows a cushioned support 1' comprising a mattress 7 disposed within a fabric casing 7 (partially sectioned). The cushioning structure formed by the spring elements 20 (or 20A, 20B, 20C, 30) interlocked with a grid forms a load bearing portion onto which the mattress overlay 6 is placed. The edges of the mattress are strengthened by support strips 8 of a foam material, with a height corresponding to the high position of the bearing plates 39 without load (i.e., when the spring elements are unloaded). The spring elements are thus held in their position and cannot move outward. This cushioned base 1' thus constructed is easily handled in one piece, it is still flexible enough that it can be transported over very narrow halls, steps, etc., and can then be laid onto the, prescribed sleeping surface.

In the embodiments of the present invention the springs are all shown arranged such that the fold lines (e.g., 22.1, 22.2) of the folding webs are parallel. However, it will be appreciated that some of the springs could be oriented at an angle of 90° to that depicted in FIG. 1, whereby neighboring spring elements yield in different directions when loaded.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cushioning support for cushions, comprising a plurality of spring elements forming a grid structure; each spring element including a multi-sided base, a compression spring structure disposed on said base, and a bearing plate disposed atop said spring structure and adapted to support a cushion; said bases being removably interconnected to vary the size and shape of the cushioning support; each base formed with connectors releasably connecting at least two, and not more than four, sides thereof directly with connectors of respective adjacent bases to form said grid structure; some of said bases having more than two sides thereof connected with sides of respective adjacent bases, whereby said grid structure is two-dimensional.

2. The cushioning support according to claim 1, wherein said spring elements are formed of a synthetic material.

3. The cushioning support according to claim 1, wherein each base includes outwardly projecting adapters, some of said adapters carrying tabs, and others of said adapters formed with recesses to receive said tabs of an adjacent base, said tabs and recesses defining said connectors.

4. The cushioning support according to claim 1, wherein said spring structure of each spring element is of one-piece construction with said base.

5. The cushioning support according to claim 4, wherein each adapter has a height equal to one-half the height of a portion of said base to which it is attached.

6. The cushioning support according to claim 1, wherein each of said multi-sided bases includes four sides, two adjacent ones of said sides having adapters with tabs, and the other two adjacent sides having adapters with recesses, wherein said tabs of each spring element are connectable to said recesses of another spring element; said tabs and recesses defining said connectors.

7. The cushioning support according to claim 6, wherein some of said spring elements are one-half the width of others of said spring elements.

8. The cushioning support according to claim 1, wherein said connectors comprise arms extending between bases of adjacent spring elements.

9. The cushioning support according to claim 1, wherein said spring structure comprises a separate member from its respective base and is connected thereto.

10. A cushioning support for cushions, comprising a plurality of elements forming a grid structure, compression springs mounted on respective ones of the elements, and bearing plates disposed atop respective springs; the bearing plates disposed closely adjacent one another to form a support surface for a cushion; the elements being removably interconnected so that the size and shape of the cushioning support can be varied to conform to the size and shape of a cushion to be supported, wherein each element includes four sides, two adjacent ones of the sides having adapters with tabs, and the other two adjacent sides having adapters with recesses, wherein the tabs of each element are connectable to recesses of another element.

* * * * *